US005246231A

United States Patent [19]

Antonious

[11] Patent Number: 5,246,231

[45] Date of Patent: Sep. 21, 1993

[54] PUTTER TYPE GOLF CLUB HEAD HAVING UNIQUE WEIGHT CONFIGURATION

[76] Inventor: Anthony J. Antonious, 7738 Calle Facil, Sarasota, Fla. 34238

[21] Appl. No.: 911,082

[22] Filed: Jul. 9, 1992

[51] Int. Cl.[5] ..... A63B 53/04

[52] U.S. Cl. ..... 273/167 F; 273/167 H; 273/169

[58] Field of Search ..... 273/167 R, 169-175, 273/167 A-167 K, 77 R, 129 K, 193 R, 194 R, 194 A, 194 B, 186.2, 164.1, 187.4, 162 R, 163 R, 162 D, 162 E, 162 F; D21/214-220

[56] References Cited

U.S. PATENT DOCUMENTS

| | | | |
|---|---|---|---|
| D. 226,617 | 4/1973 | Dohan | D21/218 X |
| 1,671,956 | 5/1928 | Sime | 273/172 |
| 2,174,212 | 9/1939 | Newsome | 273/167 H |
| 2,254,528 | 9/1941 | Hoare | 273/167 F |
| 3,035,839 | 5/1962 | Coglianese | 273/167 J |
| 3,068,011 | 12/1962 | Sano | 273/169 X |
| 3,081,087 | 3/1963 | Redd | 273/167 H X |
| 3,085,804 | 4/1963 | Pieper | 273/164.1 |
| 3,300,241 | 1/1967 | Eberwein et al. | 273/162 E |
| 3,961,796 | 6/1976 | Thompson | 273/167 A |
| 4,165,076 | 8/1979 | Cella | 273/128 K X |
| 4,173,343 | 11/1979 | Richilano | 273/169 |
| 4,693,478 | 9/1987 | Long | 273/164.1 |

FOREIGN PATENT DOCUMENTS

| | | | |
|---|---|---|---|
| 385 | of 1905 | United Kingdom | 273/169 |
| 8801525 | 3/1988 | World Int. Prop. O. | 273/167 F |

OTHER PUBLICATIONS

"Golf World" Magazine, Jul. 2, 1976 issue, page 31.
"Golf World" magazine, Jun. 3, 1988, page 32.

*Primary Examiner*—William H. Grieb
*Assistant Examiner*—Sebastiano Passaniti
*Attorney, Agent, or Firm*—N. J. Aquilino

[57] ABSTRACT

A putter type golf club head wherein at least a portion of the putter head body is undercut from the overall length of the putter head at the ends thereof. Heel and toe weight masses are located between the undercut and a central rear cavity, and are positioned closer to the center of gravity because of the undercut configuration.

6 Claims, 4 Drawing Sheets

PUTTER TYPE GOLF CLUB HEAD HAVING UNIQUE WEIGHT CONFIGURATION

BACKGROUND AND SUMMARY OF THE INVENTION

The present invention relates to putters, and in particular, to putters having a unique weight configuration.

Putter type golf club heads come in a variety of shapes and sizes. Putters with heel-toe weight have become standards in the industry because of the increased polar moment of inertia, which resists turning or torquing of the putter when a ball is struck off of the center of gravity or center of percussion. To this end, many putters have been made with weight at the extreme outer ends, and whereas this increases the polar moment of inertia, often there is a sacrifice in mass directly at the point where the ball is struck. These types of putters tend to be elongated, which are visually more pleasing and which are easier to line up.

The present invention contemplates a putter design which maintains from a vertical viewpoint the visual and aesthetic qualities of an elongated putter, but wherein the overall mass of the putter head is more effectively brought closer to the center of percussion while still maintaining a more balanced heel-toe weight configuration. Various embodiments of the invention are provided wherein at least a portion of the putter head body is undercut from the overall length of the putter at the ends. Therefore, the top ridge and adjacent upper portion of the putter head in these embodiments are considerably longer from toe to heel than the remaining lower portion of the putter head. Stated in other words, the toe and heel sections of the top ridge and the upper portion of the putter head extend beyond the length of the lower portion of the putter head. The extreme ends of the toe and heel sections of the upper portion may overlay the entire sections of the lower portions at the heel and toe, rearwardly located from the face to the rear portion of the putter head, or may overlay only a portion of the putter face adjacent the toe and heel sections. These portions are partially recessed into the face of the putter head at the ends, or similarly may overlay only a portion of the rear section of the putter head at the heel and toe, these portions being partly recessed into the rear of the putter head at the ends thereof. The heel and toe undercuts enable the top surface of the putter head to extend beyond the lower main body of the putter head, permitting the overall length of the putter head to be made longer without significantly adding to the overall weight of the club head. This arrangement also permits the primary heel and toe weight mass to be located closer to the center of percussion, or center of gravity of the club head, thereby providing increased feel and more accurate playability when a golf ball is struck at or near the center of percussion.

Among the objects of the present invention are the provision of a putter head having an elongated top ridge with lower undercut sections at the heel and toe areas; the provision of a golf club head wherein an elongated putter head has a weight configuration located closer to the center of percussion, and the provision of a putter type golf club head which is easier to align and has increased feel and more reliable playability. These and other objects of the present invention will become apparent from the following detailed description and drawings, which are exemplary only, and are not restrictive of the invention as claimed.

The accompanying drawings, which are incorporated in and constitute a part of the specification, illustrate several embodiments of the invention, and together with the description, serve to explain the principles of the invention.

DESCRIPTION OF THE PREFERRED EMBODIMENTS

Figure 1:
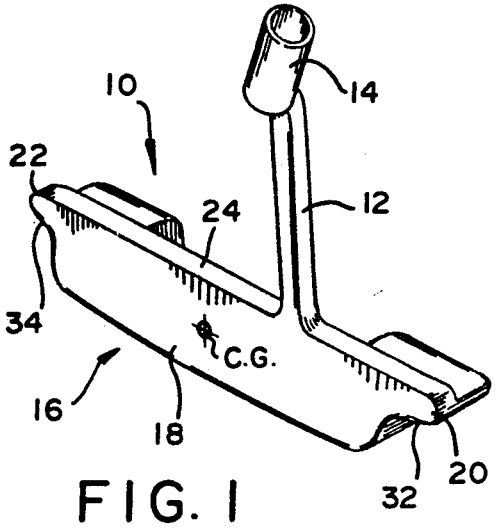
FIG. 1 is a front perspective view of a first embodiment of a putter type golf club head of the present invention.
Figure 2:
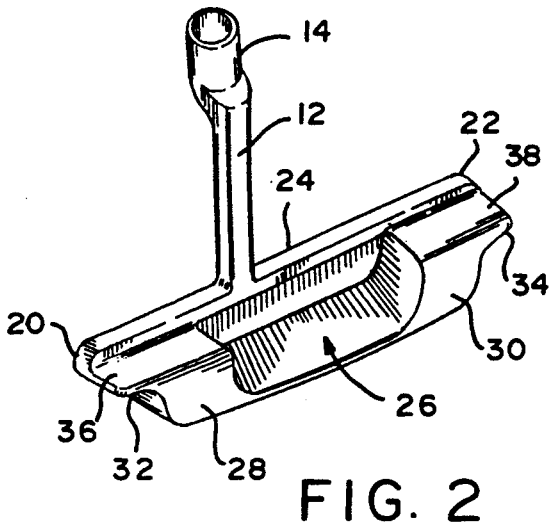
FIG. 2 is a rear perspective view thereof.
Figure 3:
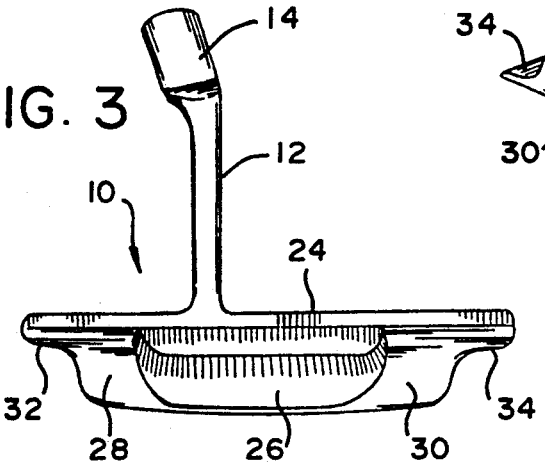
FIG. 3 is a rear elevational view thereof.
Figure 4:
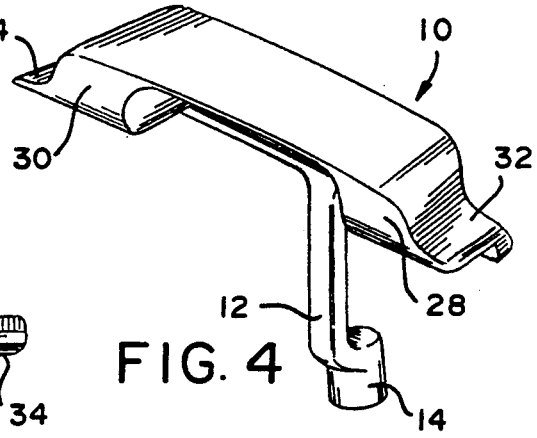
FIG. 4 is a bottom perspective view thereof.
Figure 5:
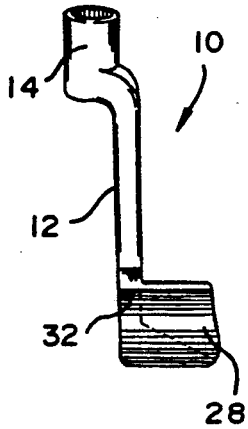
FIG. 5 is an end view thereof.
Figure 6:
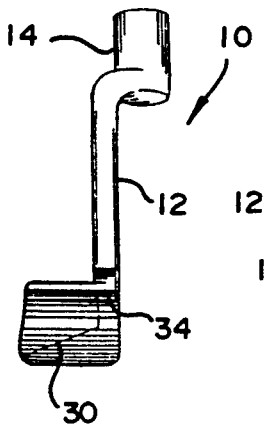
FIG. 6 is an end view taken from the opposite end of FIG. 5.
Figure 7:
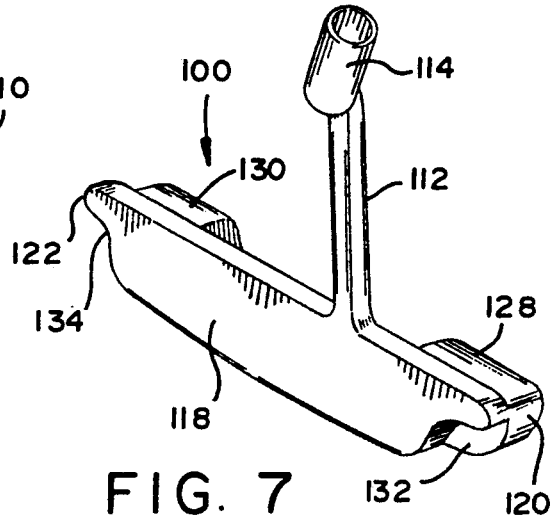
FIG. 7 is a front perspective view of a second embodiment of the present invention.
Figure 8:
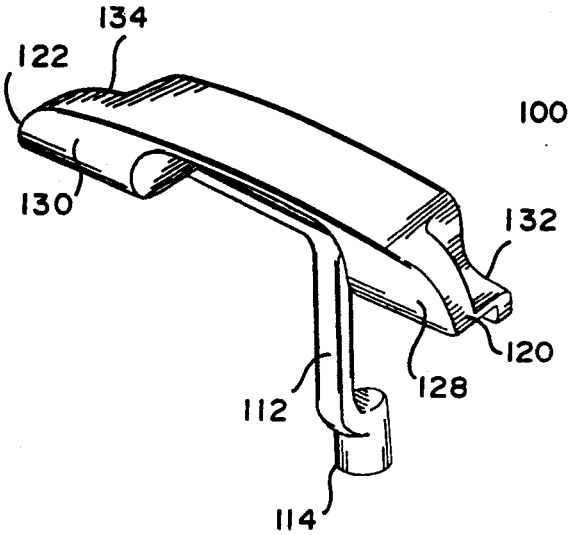
FIG. 8 is a lower rear perspective view thereof.
Figure 9:
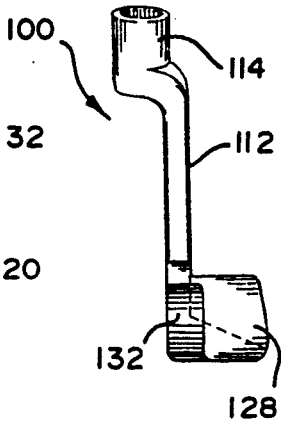
FIG. 9 is an end elevational view thereof.
Figure 10:
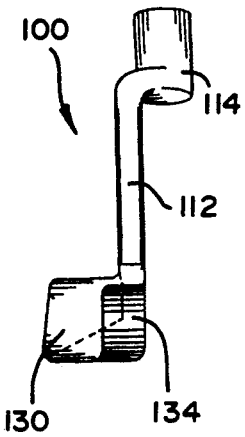
FIG. 10 is an end elevational view taken from the opposite end of FIG. 9.

FIGS. 1 to 6 show a first embodiment of a putter type golf club head 10 of the present invention wherein at least a portion of the putter head body is undercut on the overall length of the putter head 10 at the ends thereof. The putter head 10 includes a hosel 12 having a shaft socket 14 for connection with a conventional golf club shaft and grip (not shown). The putter head body 16 includes a ball striking face 18, a heel 20 and toe 22. A top ridge 24 extends the entire length of the putter head 10 between the heel 20 and toe 22. The rear of the putter head 10 is formed with a cavity 26 formed by heel weight mass 28 and toe weight mass 30. The putter head 10 is formed with a heel undercut 32 and toe undercut 34, which enables the top surface of the putter head 10, including top ridge 24 and heel ledge 36 and toe ledge 38, to extend beyond the heel weight mass 28 and toe weight mass 30, respectively, in the heel to toe direction.

This arrangement permits the overall length of the putter head 10 to be made longer, without significantly adding to the overall weight mass of the putter head 10. The arrangement also locates the heel and toe weight mass closer to the center of gravity (C.G.) of the putter head 10, thereby providing additional mass and a more solid feel when a golf ball is struck at or near the center of percussion.

FIGS. 7, 8, 9 and 10 show a second embodiment of a putter type golf club head 100 of the present invention, including a hosel 112, a shaft socket 114, a body 116 with a ball striking face 118, heel 120 and toe 122. In this embodiment, the heel weight mass 128 and toe weight mass 130 extends to the extreme ends of the heel 120 and toe 122, respectively, and partial undercuts 132 and 134 are provided which extend only partway into the ball striking face 118. This embodiment thereby provides a heavier putter head than the embodiment shown in FIGS. 1–6 and permits adjustment of the overall weight of the putter head thereby.

Figure 11:
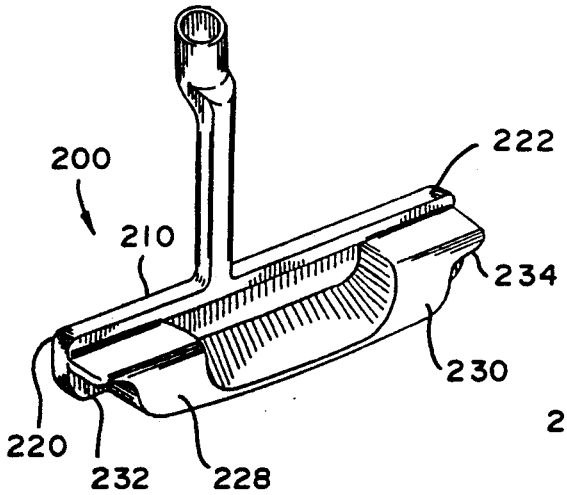
FIG. 11 is a rear perspective view of a third embodiment of the present invention.
Figure 12:
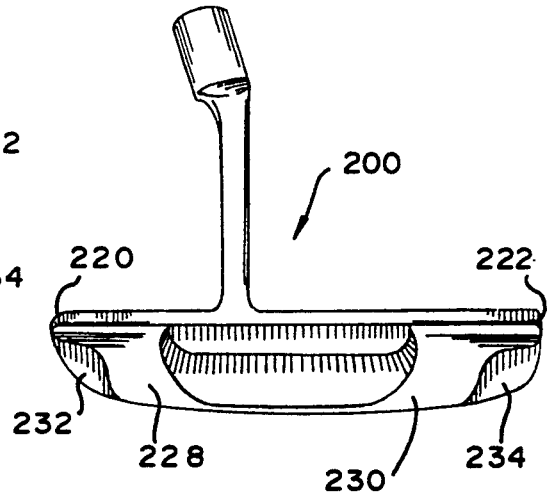
FIG. 12 is a rear elevational view thereof.

FIGS. 11 and 12 show a third embodiment of a putter type golf club head 200 of the present invention wherein the frontal portion 210 of the putter head 200 extends completely between the heel 220 and toe 222. The putter head 200 includes a heel weight mass 228 and toe weight mass 230, each of which is undercut at 232 and 234, respectively, such that the respective undercut is only located at the rear of the putter head 200 and does not extend to the front face thereof. Here again, the structure of the undercut allows for the adjustment of the overall weight of the putter head 200 by controlling the location and size of each undercut.

Figure 13:
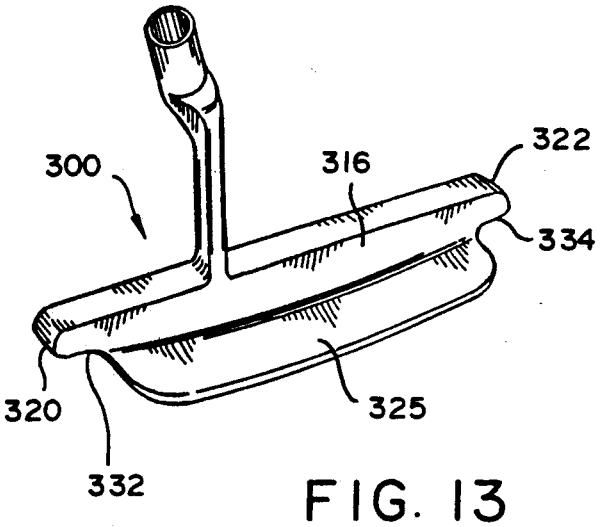
FIG. 13 is a rear perspective view of a fourth embodiment of the present invention.
Figure 14:
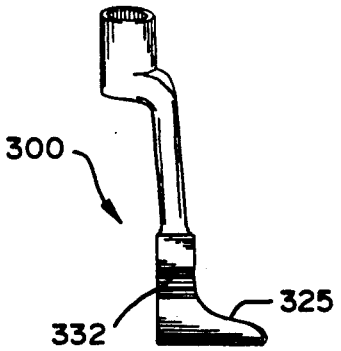
FIG. 14 is an end elevational view thereof.
Figure 15:
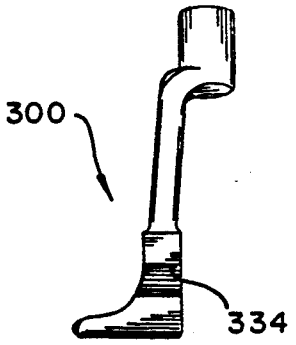
FIG. 15 is an end elevational view taken from the opposite end of FIG. 14.

FIGS. 13, 14 and 15 show another embodiment of a putter type golf club head 300, including a blade-shaped body 316 having a rearward flange 325 extending therefrom. As with the first embodiment, the heel 320 and toe 322 are formed with a heel undercut 332 and a toe undercut 334, respectively. With this embodiment, the overall length of the putter head 300 is substantially longer, with very little addition of weight.

Figure 16:
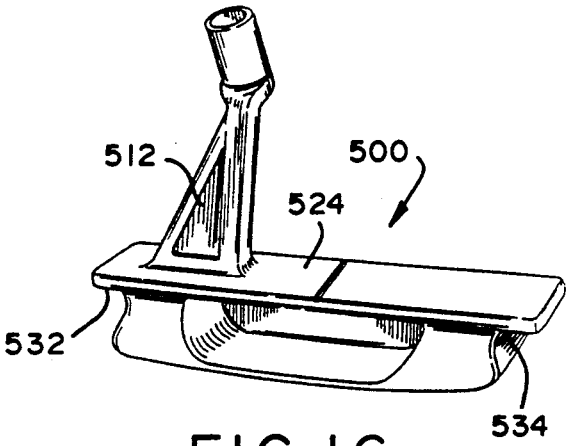
FIG. 16 is a rear perspective view of a fifth embodiment of the present invention.
Figure 17:
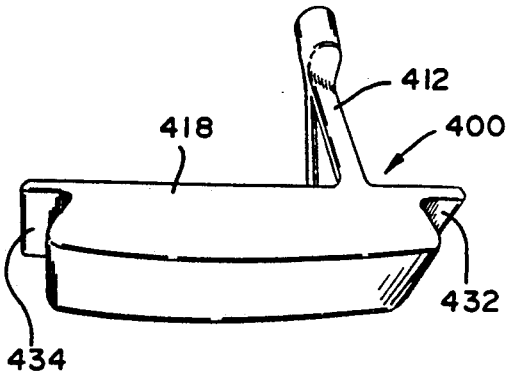
FIG. 17 is a lower front perspective view thereof.

FIGS. 16 and 17 show a fifth embodiment of a putter type golf club head 400 having a delta-shaped hosel 412 extending perpendicular to the ball striking face 418 of the present invention and which is positioned on a flat top surface 424. The rear of the putter head 400 is provided with a cavity 426 and heel weight mass 428 and toe weight mass 430. The flat upper surface 424 includes a heel undercut 432 and a toe undercut 434.

Figure 18:
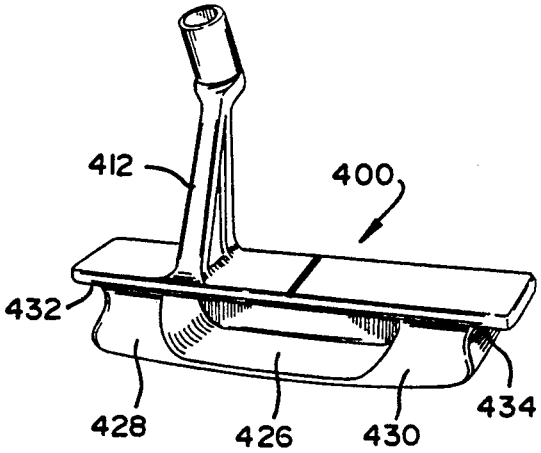
FIG. 18 is a rear perspective view of a sixth embodiment of the present invention.

Still another embodiment of a putter type golf club head 500 is shown in FIG. 18, including a triangular-shaped hosel 512 extending parallel to the ball striking face and which is formed on a flat top surface 524. This putter head 500 is provided with a heel undercut 532 and a toe undercut 534 a with the previous embodiment.

Figure 19:
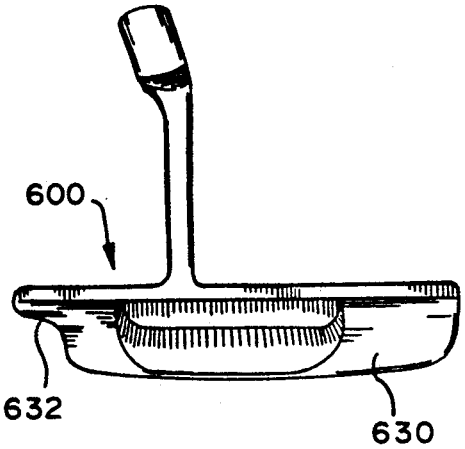
FIG. 19 is a rear elevational view of a seventh embodiment of the present invention.

FIGS. 19 through 24 show various embodiments of putter type golf club heads wherein undercuts are provided at the heel or toe portion only. FIG. 19 shows a putter type golf club head 600 of the present invention having a heel undercut 632. There is no undercut adjacent the toe mass 630, thereby distributing more weight toward the toe and shifting the center of mass of the putter 600 in that direction.

Figure 20:
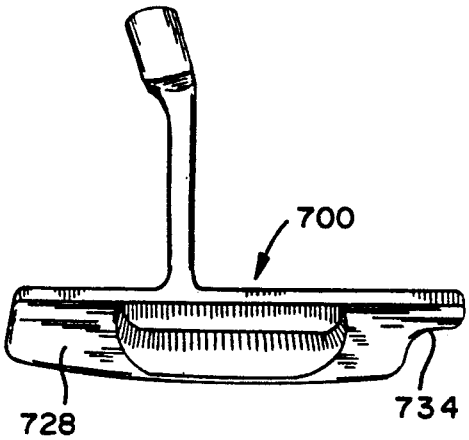
FIG. 20 is a rear elevational view of an eighth embodiment of the present invention.

FIG. 20 shows a putter type golf club head 700 having a toe undercut 734. In this embodiment, the heel mass 728 does not include an undercut, and more weight is shifted toward the heel of the putter head 700, thereby moving the center of gravity toward the heel direction.

Figure 21:
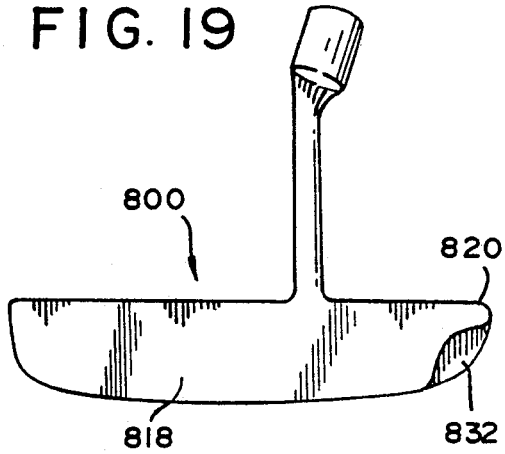
FIG. 21 is a front elevational view of a ninth embodiment of the present invention.

FIG. 21 illustrates an embodiment of a putter type golf club head 800 having a partial undercut 832 located adjacent the heel 820 of the club head 800. The undercut 832 is formed in the front face 818, and extends partway toward the rear of the putter head 800.

Figure 22:
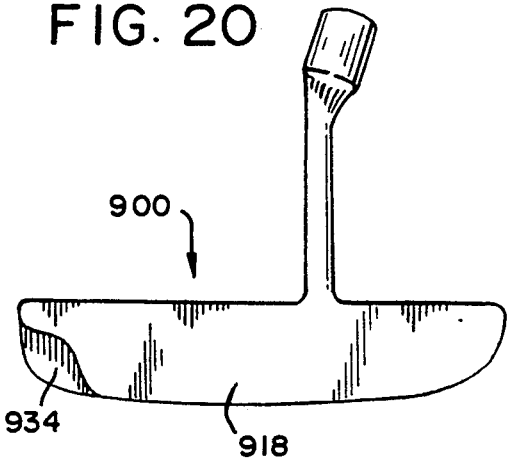
FIG. 22 is a front elevational view of a tenth embodiment of the present invention.

FIG. 22 shows another embodiment of a putter type golf club head 900 of the present invention having a toe undercut 934 which extends from the ball striking face 918 partway toward the rear of the putterhead 900.

Figure 23:
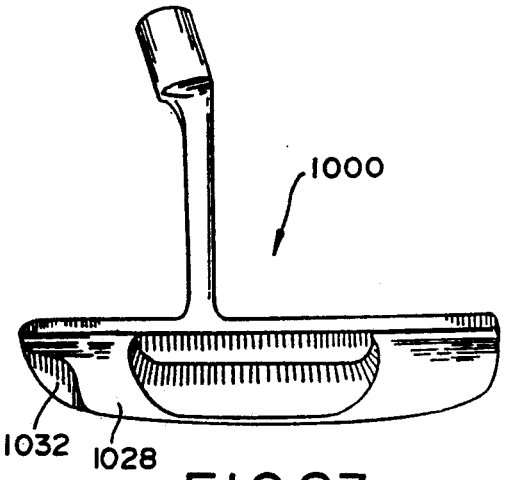
FIG. 23 is a rear elevational view of an eleventh embodiment of the present invention.

FIG. 23 shows an embodiment of a putter type golf club head 1000 having a heel undercut 1032 formed in the heel weight 1028 and extending only partway toward the front of the club head 1000.

Figure 24:
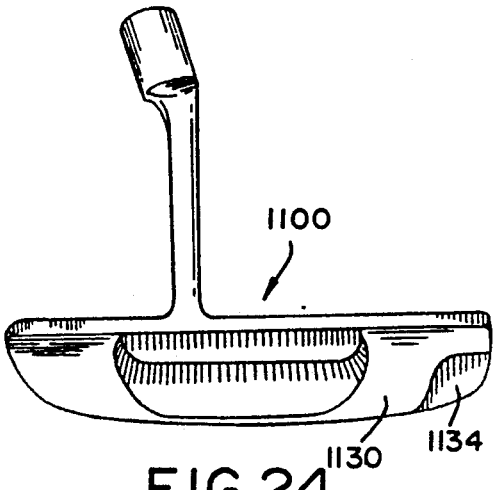
FIG. 24 is a rear elevational view of a twelfth embodiment of the present invention.

FIG. 24 shows another embodiment of a putter type golf club head 1100 having a toe undercut 1134 formed in the toe mass 1130 of the putter head. The undercut 1134 extends partway toward the front of the club head 1100.

In each of these embodiments, it will be appreciated that the undercuts shift the overall weight and center of gravity of the putter head depending upon the location of the undercut.

It will be appreciated that the above-disclosed embodiments are exemplary only, and that other designs and configurations are possible in keeping within the scope of the present invention as defined in the following claims.

I claim:

1. A putter type golf club head including a hosel and shaft socket, heel, toe, ball striking face, top surface including a top ridge, a bottom surface, rear surface, heel weight mass, toe weight mass and a cavity formed therebetween, said putter being characterized by undercut portions on said club head located at the heel and toe and positioned under the top surface of the putter head;

said undercut portions extending between the ball striking face and the rear surface of the club head;

said heel and said toe weight masses each being positioned between said cavity and said undercut portions and spaced inwardly from said heel and said toe, respectively;

outer edges of said heel and toe masses defining inner limits of said undercut portion in the heel to toe direction.

2. The golf club head of claim 1 further defined by said heel and toe weight masses being positioned below said top ridge of said club head.

3. The golf club head of claim 1 wherein the undercut portions extend partway between the ball striking face and the rear surface.

4. The golf club head of claim 3 wherein the undercut portions extend from the ball striking face to approximately midway between the ball striking face and the rear surface.

5. The golf club head of claim 3 wherein the undercut portions extend from the rear surface to a point approximately midway between the ball striking face and the rear surface.

6. The golf club head of claim 1 wherein the entire top surface of the club head is formed in a common plane.

* * * * *